US005541577A

United States Patent [19]

Cooper et al.

[11] Patent Number: 5,541,577

[45] Date of Patent: Jul. 30, 1996

[54] ELECTROMAGNETIC ASSET PROTECTION SYSTEM

[75] Inventors: Michael N. Cooper, Hewlett, N.Y.; Erik Hoffer, Somerset, N.J.

[73] Assignee: Consolidated Graphic Materials, Inc., Somerset, N.J.

[21] Appl. No.: 452,381

[22] Filed: May 26, 1995

[51] Int. Cl.[6] ..... G08B 13/187

[52] U.S. Cl. ..... 340/551; 116/4; 340/540; 340/541; 340/550; 340/572

[58] Field of Search ..... 340/551, 572, 340/550, 540, 541; 116/4, DIG. 1

[56] References Cited

U.S. PATENT DOCUMENTS

| | | | |
|---|---|---|---|
| 3,665,449 | 5/1972 | Elder et al. | 340/551 |
| 3,983,552 | 9/1976 | Bakeman, Jr. et al. | 340/551 |
| 4,063,229 | 12/1977 | Welsh et al. | 340/572 |
| 4,063,230 | 12/1977 | Purinton et al. | 340/568 |
| 4,075,618 | 2/1978 | Montean | 340/551 |
| 4,262,284 | 4/1981 | Stieff et al. | 340/542 |
| 4,309,697 | 1/1982 | Weaver | 340/572 |
| 4,334,214 | 6/1982 | Satou et al. | 340/552 |
| 4,435,699 | 3/1984 | Tacussel | 340/539 |
| 4,605,922 | 8/1986 | Blattman et al. | 340/552 |
| 4,639,902 | 1/1987 | Leverance et al. | 367/93 |
| 4,660,024 | 4/1987 | McMaster | 340/522 |
| 4,660,025 | 4/1987 | Humphrey | 340/572 |
| 4,980,670 | 12/1990 | Humphrey et al. | 340/551 |
| 5,029,291 | 7/1991 | Zhou et al. | 340/551 |
| 5,111,184 | 5/1992 | Heaton et al. | 340/550 |
| 5,169,188 | 12/1992 | Kupperman et al. | 340/572 |
| 5,189,396 | 2/1993 | Stobbe | 340/540 |
| 5,353,010 | 10/1994 | Sanetra | 340/572 |
| 5,406,263 | 4/1995 | Tuttle | 340/572 |

FOREIGN PATENT DOCUMENTS

| | | |
|---|---|---|
| 1330481 | 9/1973 | United Kingdom . |

*Primary Examiner*—Glen Swann

*Attorney, Agent, or Firm*—Harold James; Robert L. Epstein; James & Franklin

[57] ABSTRACT

The security of articles, and particularly articles in transit, is checked by detecting the status of a magnetic strip attached to the articles at a strategic location when the strip is subjected to an electromagnetic field which causes the strip to substantially saturate magnetically, the status of an improper strip, that is to say, a strip whose electromagnetic properties differ from those of a proper strip as a result of physical modification or disparity, being reflected in the nature of the electromagnetic field emanating therefrom, detection of the status of that field providing an indication of whether the strip is proper or not. The same principles can be applied to the coding of articles for validation of identity or authenticity.

26 Claims, 5 Drawing Sheets

FIG. 1
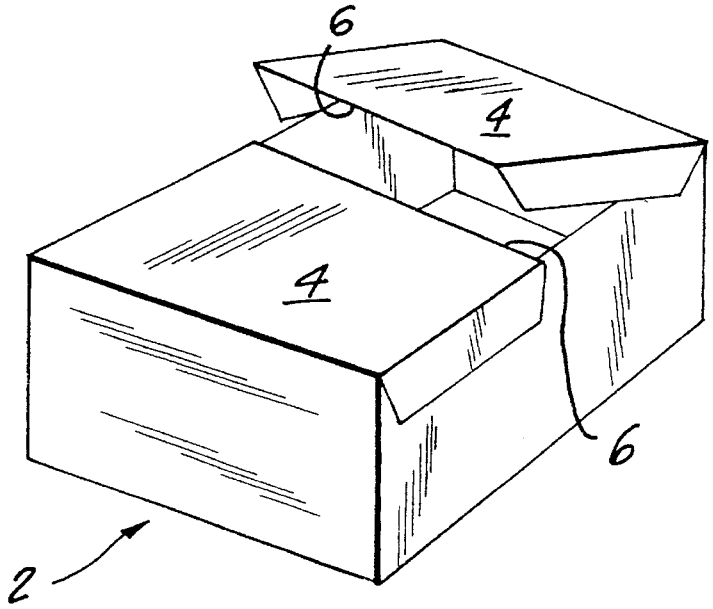
FIG. 2
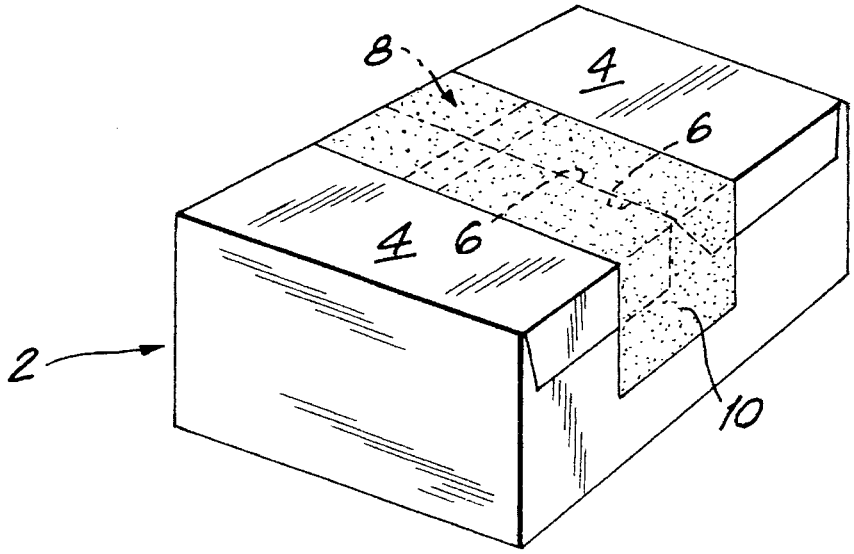
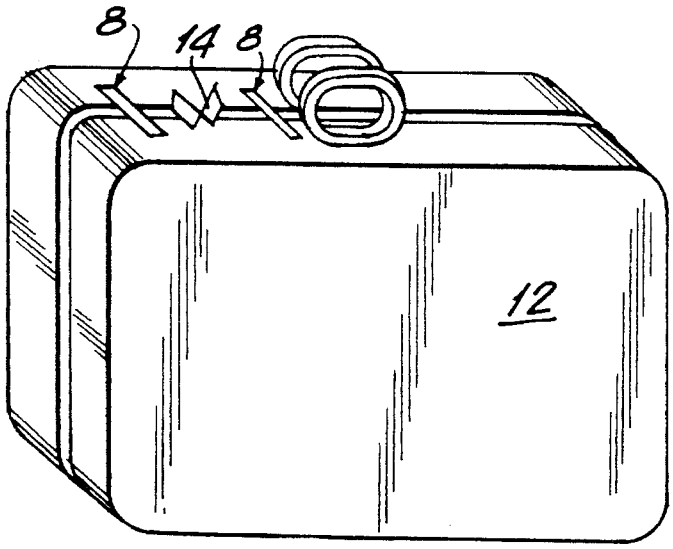
FIG. 3

NO STRIP PRESENT
TRANSMITTER OUTPUT
0
2.50ms
3.75ms
1.25ms
5.0ms

VALID STRIP PRESENT
+ Vo
− Vo

BANDPASS AMPLIFIER OUTPUT (5−15 Fo)

+ 4v
− 4v

73
HIGH THRESHOLD
LOW THRESHOLD
12
PEAK DETECTOR OUTPUT #1 (5−15 Fo)
Va
0

73
HIGH THRESHOLD
73
LOW THRESHOLD
62
Va + 4
0

NO STRIP PRESENT

VALID STRIP PRESENT
+1v
-1v
BANDPASS AMPLIFIER OUTPUT (25 -30 Fo)

ADJUSTABLE THRESHOLD
Vb
0

ADJUSTABLE THRESHOLD
Vb+1
0
PEAK DETECTOR OUTPUT # 2 (25-30Fo)

0

+V
0
ALARM CONDITION MET
ALARM TRIGGER CIRCUIT

ELECTROMAGNETIC ASSET PROTECTION SYSTEM

FIELD OF THE INVENTION

This invention relates to a system for detecting whether an object is genuine or has been tampered with, tampering involving unauthorized treatment of the object and/or removal of the operative detection device and replacement of that device with a non-identical device. The system has particular application to detecting whether a container has been opened, but it also has applicability to the validation of the genuineness of objects such as jewelry, clothing, computers or the like.

DESCRIPTION OF THE RELATED ART

One of the most immediate fields of practicability for the system of the present invention is to provide for security for packages. Vast numbers of such packages are daily shipped from one place to another, and one of the most popular modes of shipment involves bringing to a central location packages emanating from many different locations and then transshipping those packages to the correspondingly many different locations to which they are addressed. The problem of pilferage of such packages both while en route to the central location and while at the central location is serious, and shippers, in an effort promptly to detect tampering and thereby to inhibit it, check packages while they are at that central location to ensure that they have not been tampered with.

One type of checking procedure utilizes special tamper-evident tape secured over the seam between the cover panels of the package, the tape being specially constructed so that no matter how carefully it may be surreptitiously removed from the package, the fact of removal will become immediately evidenced, usually by leaving some indelible legend or symbol on the package. However, if such a tape is very carefully cut rather than being removed, that visual indication of tampering will not become effective, and the fact that the tape has been carefully cut can often be successfully hidden. To make the task of the would-be pilferer more difficult, and for other purposes, bar code strips are often applied to the packages, sometimes being incorporated into the tamper-evident tape, the bar code strips of each package being sensed at the central gathering location for the packages, usually for the primary purpose of inventory and routing control. If that bar code strip has not been cut most carefully the bar code detector will be affected in such a way as to indicate that that particular package has been tampered with. However, here again very skilled and careful cutting of the bar code strip can fool the bar code scanner and thus not reveal the pilferage.

SUMMARY OF THE INVENTION

In accordance with the present invention a pilfering and/or genuineness or validation testing system utilizes as the critical element a magnetic strip which has the characteristic, when appropriately energized by an external electromagnetic field, of putting forth an electromagnetic field of a particular identifiable character when the strip is in proper condition but putting forth a significantly different and readily identifiable electromagnetic field when the strip is not in proper condition.

One thing which may change the condition of the strip from proper to improper is that the strip has been cut, thereby reducing its continuous length. If such a strip is placed across the seam of a package so that the package cannot be opened without severing the strip, once the package has been opened and then reclosed the strip will remain severed and its status as an improper strip will be detected. Another type of improper strip is a strip whose continuous length or other physical or magnetic characteristic differs from that associated with a proper strip. Thus if a wrongdoer were to remove the original proper strip and attempt to avoid detection by replacing it with another strip, an action which would be most difficult to accomplish, unless the replacement strip were very closely the same as the original strip in dimensions, magnetic nature and the like, the pilferage would still be detected.

In accordance with the present invention, a person at a central location of a shipping company can, with an appropriately designed scanner, hand-held or incorporated into automatic equipment, apply the scanner to the proper location on one package after another, and get an immediate indication of whether or not a package has been tampered with. Since in many instances that person would in any event be using a scanner of different construction to scan bar code tapes attached to the packages for reasons other than pilferage detection, and since the two types of scanning can be carried out substantially simultaneously and, in the case of hand-held scanners, by the same manual action, pilferage detection can be accomplished without any appreciable additional time or effort over and above what must be done in any event for other business purposes.

In addition, means are preferably provided for sensing the existence of conditions which would make pilferage-sensing inaccurate and advising the operator that such a situation exists, so that the operator will not be misled by false signals and can retest at a more propitious moment.

The magnetic strip which is the operative element of the present system is preferably hidden from view, as by one of the tamper-evident strips which visually signals that it has been removed, thus not only making the existence and location of the magnetic strip less obvious but also making it most difficult, if not impossible, to cut the magnetic strip and then replace it with a similar uncut strip. The magnetic strip may also be incorporated into a tamper-evident strip, thus avoiding the need for duplicate labels and their application costs.

In its preferred form the magnetic strip is made of material which is characterized by an appropriate shape factor, that is to say, the characteristic of producing, when suitably saturated by an electromagnetic field, different fields depending upon the relationship between its length and its cross-sectional area. Thus a given strip when suitably energized by an alternating electromagnetic field of appropriate frequency produces an output field rich in harmonics of the energizing frequency. A signal can be derived therefrom the amplitude of which will vary with the continuous length of the strip, thus enabling the system to distinguish between an uncut strip on the one hand, producing a large signal, and a cut strip or no strip at all on the other hand, producing a smaller signal or no signal respectively. Further, if desired, the same type of detection can be used for validation or identification purposes by distinguishing between an uncut strip of genuine or proper length and an uncut strip of greater length, thus enabling the system to distinguish between different types of uncut strips and hence the different types of products to which those different strips may respectively be secured. A similar type of differentiation can be based upon the presence of strips whose magnetic properties differ so as to generate output fields producing significantly different detected signals.

Another type of magnetic material which can advantageously be used in the system of the present invention is one which has the characteristic of losing virtually all of its response signal strength when cut, no matter where it is cut. Such materials have the advantage, over the "shape factor" materials, that a cut anyplace along their length will produce the desired change in transmitted field, but they have the disadvantage that the output signals produced by them are not as length-sensitive as the "shape factor" materials, thus inhibiting the ability to use the system for validation or identification purposes based upon the length of the active magnetic strip.

The sensing of the magnetic strips used in the system of the present invention is readily accomplished by a scanner carrying transmitting and receiving antennas, preferably with the transmitting antenna above the receiving antenna, so that those antennas during the detection process are always in substantially the same position with respect to one another and to the strip being sensed, the receiving antenna preferably comprising a pair of oppositely wound coils which serve to null field output from the magnetic strip at the frequency of the transmitted field but not nulling the harmonics of that transmitted frequency.

It is the prime object of the present invention to provide a system for detecting pilferage or lack of genuineness of objects which is more positive and reliable than has previously been the case, and which can be carried out efficiently and effectively in a commercial environment.

It is another object of the present invention to provide a system for determining whether an object has been tampered with by utilizing, either alone or in conjunction with other tamper-detecting means, a magnetic strip which, when suitably energized by an electromagnetic field, produces a significantly different field output when that strip is in proper condition or not, and in particular when that strip has been cut or not.

A further object of the present invention is to provide a system for detecting pilferage which also has validation and anti-counterfeiting ability, depending on the recognition of differences in the field produced by magnetic strips when suitably energized and saturated depending upon the dimensions and other magnetic characteristics of continuous lengths of said strips.

BRIEF DESCRIPTION OF THE DRAWINGS

To the accomplishment of the above, and to such objects as may hereinafter appear, the present invention relates to a system for determining pilferage and the like, and equipment to be used therein, as described in this specification, taken together with the accompanying drawings, in which FIG. 1 is a three-quarters perspective view of a typical package in the course of being closed;

FIG. 2 is a similar view of that package with the seam between the top cover panels of the package spanned by pilferage-prevention means of the present invention;

FIG. 3 is a three-quarters perspective view illustrating how the pilferage-prevention means of the present invention can be used to detect whether a zippered or otherwise-closed suitcase has been surreptitiously opened;

DESCRIPTION OF THE PREFERRED EMBODIMENTS

Figure 4:
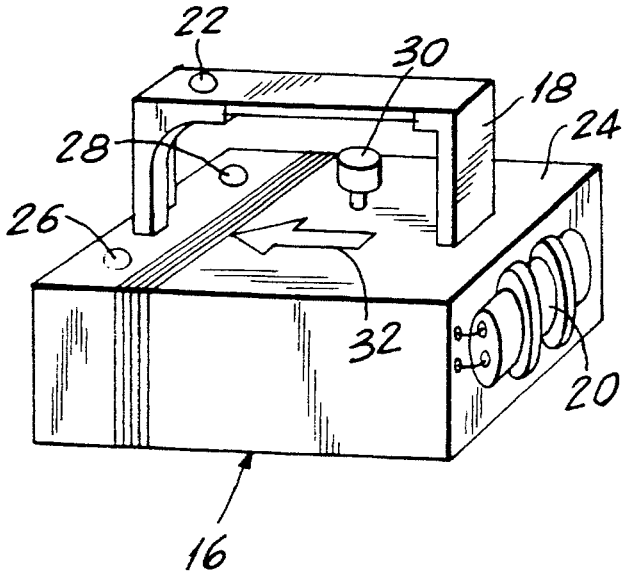
FIG. 4 is a three-quarters perspective view of a scanner that can be used in accordance with the present invention.

FIGS. 1–3 exemplify typical ways in which the system of the present invention may be used. FIGS. 1 and 2 illustrate the system when it is used to detect whether a carton, generally designated 2, has been tampered with. The carton has foldable top walls 4 adapted to be folded down to close the top of the container, with their edges 6 meeting at a seam. FIG. 1 shows the container with one top wall 4 folded down and the other top wall 4 partially folded down. Once the top walls 4 have been fully folded down a strip, generally designated 8, is secured to the top wall of the container 2 so as to extend across the line where the edges 6 meet. That strip 8 may consist of magnetic material of appropriate type, but it is preferred that the magnetic strip itself be quite narrow so that it is easily cut, and hence the strip 8 will usually comprise a length of adhesive material which carries lengthwise thereof an elongated narrow strip of appropriate magnetic material, with that magnetic strip preferably extending substantially equally to one side and the other of the seam where the edges 6 meet. The strip 8 may be covered by a sealing tape 10 which not only secures the top walls 4 in carton-closing position but also hides the strip 8 from view. For added security the tape 10 may be of the tamper-evident type, thus significantly adding to the security provided by the instant system. The tape 10 can also carry bar code indication conventionally used by shippers for carton identification and inventory and routing purposes. The arrangement of FIGS. 1 and 2 is typical of that which would be employed by package shipping companies. If one seeks to obtain .access to the interior of the carton 2 by lifting one of the cover panels 4 it would be necessary to sever the magnetic portion of the strip 8.

Illustrative of the wide range of applicability of the instant system is FIG. 3, which discloses the strips 8 as they may be used to detect unauthorized opening of a suitcase 12 having a zippered closure 14. The strips 8 are placed across-the zipper seam to both sides of the zippers themselves, so that if the zippers are moved to open the suitcase the strips 8 will necessarily be severed.

The system of the present invention involves the use of a magnetic strip 8 the mechanical and magnetic characteristics of which are such that it will be possible to distinguish between preselected uncut "proper" lengths of that magnetic material and identical overall lengths which are not continuous or which differ from the "proper" strips in certain ways. This involves the choice of suitable magnetic materials for the strips 8.

Soft magnetic materials have well recognized hysteresis characteristics such that when those materials are subjected to an electromagnetic field of appropriate magnitude and frequency they generate and radiate electromagnetic fields which differ from the received field, usually in terms of a greater harmonic frequency content. Hence if an object carrying such a magnetic strip is subjected to an electromagnetic field of appropriate frequency and amplitude the field emanating from that strip will consist of the received frequency plus substantial harmonic content. Moreover, with many such magnetic materials the nature, and particularly the harmonic content of the produced field, will be a factor of the physical dimensions of continuous lengths of that strip. This is generally referred to as the "shape factor". Materials of that type are generally in the form of crystalline ribbons and foils such as those provided under the trade name "Permalloy" and "Supermalloy". The shape factor for such materials refers to their property of producing different fields depending upon the ratio of their continuous lengths to the square root of their cross-sectional area. Thus if such a strip of a given length and cross-sectional area will, when suitably energized, produce output harmonics of a given magnitude, the same length of strip when cut in half will produce fields of only approximately one-half of the original magnitude, even though the total length of the strip is the same. Hence if one irradiates such a strip with a driving signal of appropriate frequency and amplitude and measures the amplitude of certain characteristics of the resulting electromagnetic field one can determine, within limits, the length of the continuous portion or portions of the strip. When one knows the original continuous length of a given strip that detection permits one to determine whether the strip retains the same continuous length, thus enabling one to ascertain whether an original strip has been severed or not. In addition, the same type of detection can be used for validation purposes, to distinguish between strips of appreciably differing physical dimensions such as length or cross-sectional area, or appreciably different magnetic characteristics. Since the shape factor of crystalline ribbons and foils of crystalline magnetic material is more favorable than is the case with amorphous magnetic materials, crystalline materials are preferred for use in the instant invention. Moreover, crystalline ribbons and foils of magnetic material tear like standard paper labels do and thus allow easier integration or association of such strips with tamper-evident or other conventional carton sealing strips 10.

Because for strips of given cross-sectional area it is differences in continuous length which cause "shape factor" magnetic material to be suitable for use in the present invention it is important that such materials be used in such a fashion that if they are severed as a consequence of pilfering the change in continuous length produced thereby will be maximized. Hence such strips when used as shown in FIGS. 1–3 should extend substantially equally to one side and the other of the place where they would be severed if the container were to be opened, in order to maximize the sensitivity of pilfer detection. Departures from that position can be tolerated, depending on the sensitivity of the detection circuitry. With circuitry readily available departure of the cut line from the midpoint of the strip up to ±20% of its uncut length can be tolerated.

There is another type of magnetic material which can advantageously be used in accordance with the present invention. These include special magnetic materials, such as those produced by Knogo under the name "Superstrip" and by Sensormatic under the name "Pin Wall", which have the characteristic of losing virtually all of their response signal strength when suitably exposed to an external field if they are cut anywhere or even adversely handled. With such magnetic materials the location along the strip where the strip may be severed is not at all critical.

Indeed, even amorphous material such as Allied Signal's "Metglas" or Hitachi's "Cobalt Alloy Foil" could provide satisfactory responses when used in accordance with the present invention if proper choices are made regarding the strip's length, width and thickness.

As at present advised, we prefer to use for the magnetic strip 8 ribbon of the Permalloy type typically 1 mil thick and 1/16 of an inch wide. When subjected to a sinusoidal electromagnetic field at a frequency of 218 Hz such a strip should have a permeability above 40,000 and a shape factor figure of merit in excess of 200. For the width and thickness indicated we find that using a strip 2 inches long provides for adequate sensitivity to pilferage, because when such a strip is severed within ±20% of its center point both of the resulting continuous lengths can be readily distinguished from the 2-inch standard length. It should be understood, however, that these parameters represent the best mode of which we are aware at the present time, and it is obvious that many variations may be made therein.

Figure 5:
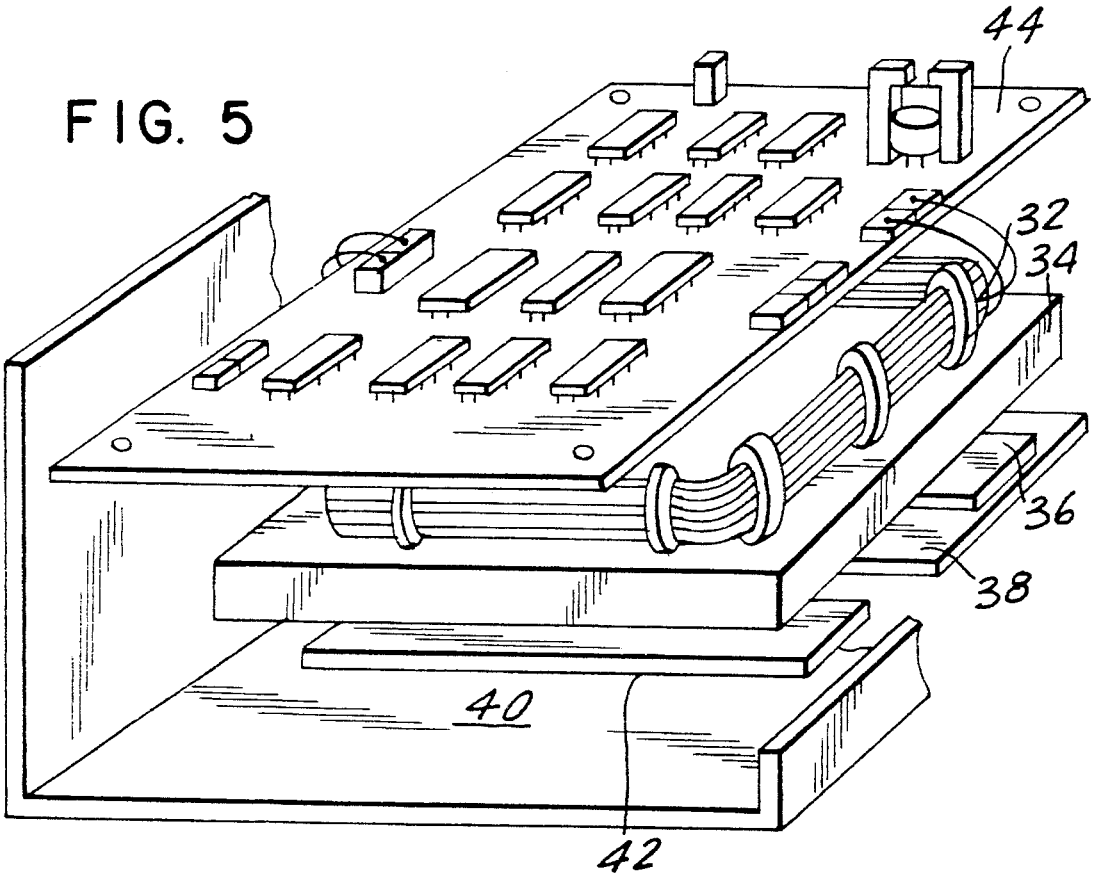
FIG. 5 is an exploded view showing a preferred arrangement of sub-assemblies in that scanner.

FIGS. 4 and 5 illustrate a typical hand-held scanner which may be used as such, or incorporated into a bar code scanner when bar code detection and pilferage detection are both to be effected. It comprises a casing generally designated 16 which contains or carries the electrical components of the detection system. It may be provided with a handle 18 so that it can be appropriately manually manipulated. It may be designed to be plugged into a conventional electrical source but as here specifically disclosed it is self-powered, provided with a battery pack 20 electrically connected to its electrical components. It may be provided with an actuating pushbutton 22, here shown as located on the handle 18 for ready manual actuation, and its top wall 24 provides visual access at 26 and 28 to visual indicators such as LEDs, a sound producing beeper or the like 30, and an arrow 32 indicating the direction in which the scanner should be moved in order to carry out the scanning function. The casing 16 contains, as may best be seen in FIG. 5, a coil 32 for producing the actuating electromagnetic field, the coil being mounted on a fiberboard spacer 34 located above a receiver coil 36 mounted on a cardboard spacer 38 which is in turn spaced from the bottom wall 40 of the casing by means of wood or cardboard shims 42. Above the transmitting coil 32 is a printed circuit board 44 which carries, suitably electrically connected, the electronic components for the transmitting and receiving circuitry.

Figure 6:
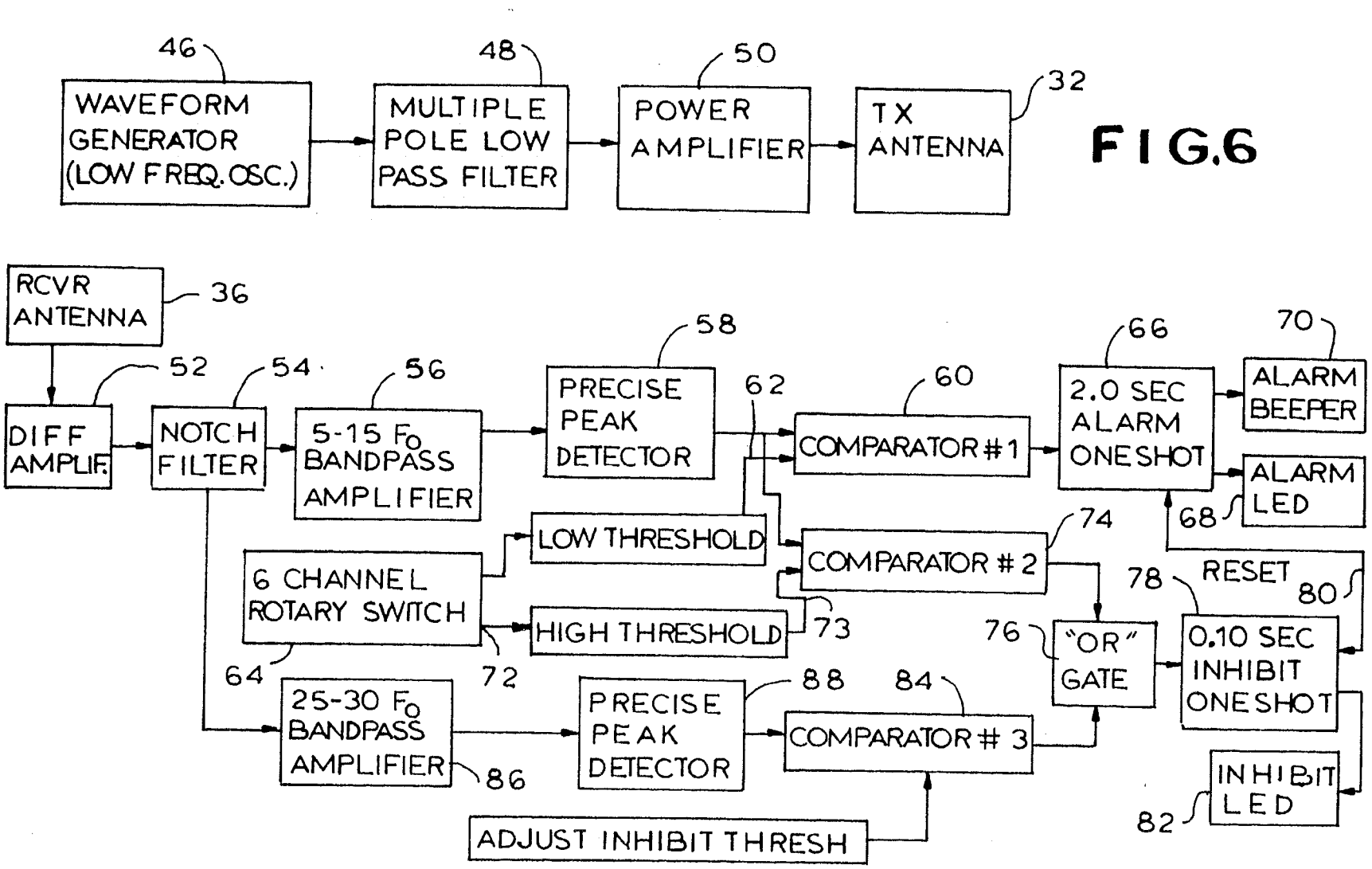
FIG. 6 is a block diagram view of the transmitting and receiving circuits of a preferred system.
Figures 7A, 7B, 8A, 8B, 9A, 9B:
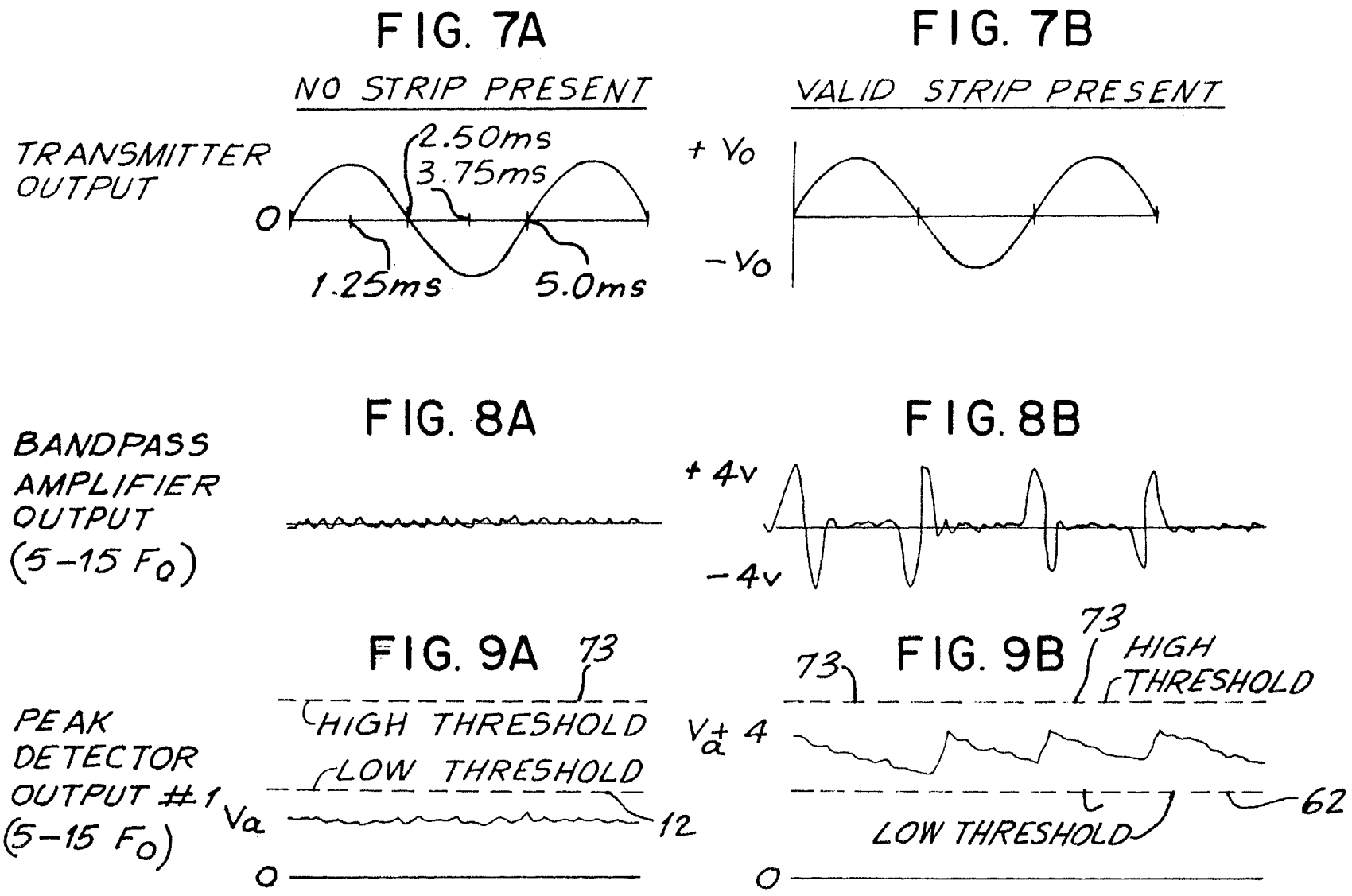
FIGS. 7–12 A–B illustrate typical wave forms in the transmitter and receiver systems when no magnetic strip is present during detection (A) and a valid uncut ("proper") strip is present (B) at the transmitter output (FIG. 7), the bandpass amplification output (5–15 $F_0$) (FIG. 8), the peak detector output (5–15 $F_0$) (FIG. 9), the bandpass amplification output (25–30 $F_0$) (FIG. 10), the peak detector output (25–30 $F_0$) (FIG. 11) and the alarm triggering circuit (FIG. 12) respectively.
Figures 10A, 10B, 11A, 11B, 12A, 12B:
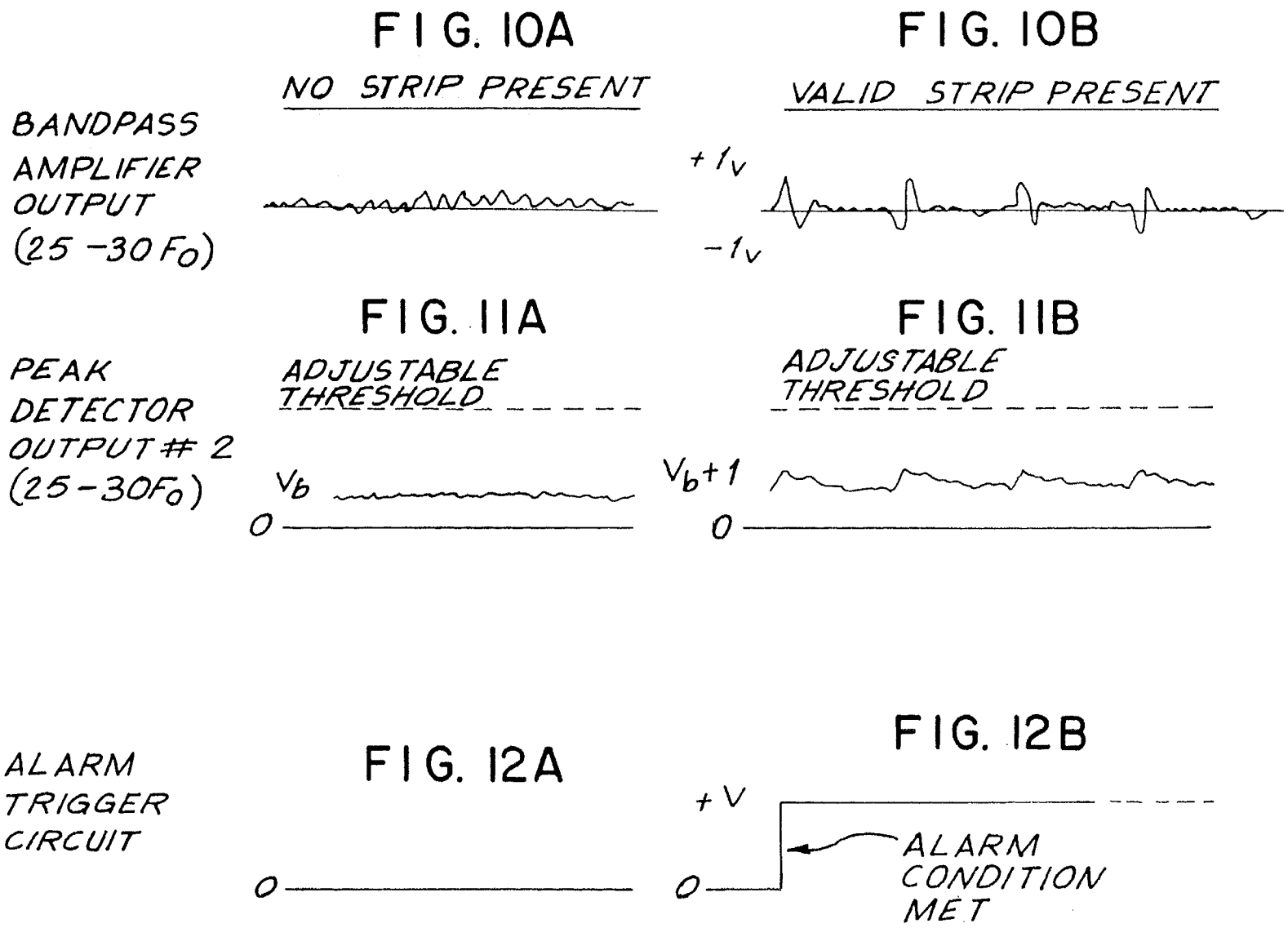

That transmitting and receiving circuitry, the specific details of which are conventional, is shown in block diagram form in FIG. 6, and it will be understood that the circuitry details of the individual blocks in that diagram are relatively conventional.

The transmission system, producing the electromagnetic field which acts upon and preferably saturates the magnetic strip 8, may comprise a crystal oscillator or a wave form generator 46 which may generate a square wave signal of appropriate magnitude the output of which is fed to a multiple pole low pass filter 48 which converts the square wave into a sinusoidal wave having the desired frequency $F_0$, the output of the filter 48 being fed to a power amplifier 50 which in turn feeds the transmitter antenna 32. Emanating from that antenna and, when the scanner 16 is properly positioned over the magnetic strip 8, impinging upon the magnetic strip 8 is an electromagnetic field of frequency $F_0$ whose amplitude is such as to magnetically saturate the strip 8 and cause it to generate and radiate an electromagnetic field which, when the strip 8 is formed of appropriate magnetic material, comprises the fundamental frequency $F_0$ and its harmonics, probably up to and including the 50th harmonic. The frequency $F_0$ and the magnitude of the transmitted field will be appropriately chosen to correspond to the magnetic characteristics of the strip 8. Frequencies in the range of 100 Hz–1000 Hz may well be appropriate.

The receiver coil 36 is mounted in the scanner 16 so as to be relatively close to the strip 8, perhaps within less than one-half inch from it. It preferably is constituted by a pair of oppositely wound coils which have the effect of cancelling out any distant signals which may be detected and which are not involved in the pilferage detection of the present invention, but not cancelling out signals emanating from a relatively close source such as the strip 8. The outputs of these two windings are fed to a differential amplifier 52 which, as the name implies, amplifies the differences between the two detected signals, and the output of that differential amplifier 52 is fed to a notch filter 54 so designed that its center frequency corresponds to $F_0$, thereby to filter out any reception by the receiver antenna 32 of direct output $F_0$ from the transmitter antenna 32 while passing signals having frequencies substantially different from $F_0$. Since the magnetic strip 8 of the type under discussion will, when energized by an electromagnetic field having a frequency $F_0$, produce and radiate signals having frequencies which are harmonics of $F_0$, the notch filter 54 will pass those harmonics.

One of the outputs from the notch filter 54 goes to a bandpass amplifier 56 designed to pass signals at the lower harmonic frequencies with respect to $F_0$, such as 5–15 $F_0$. Such signals will be present only if a strip 8 is present. In the absence of a strip 8 substantially no such harmonics will be present. The magnitude of those lower harmonics emanating from the strip 8 will be determined by the shape factor of that strip and by the continuous length of the strip. As has been pointed out, if one starts with a 2-inch strip the peak magnitude of a signal representative of those lower harmonics may be 15 volts, but if that strip is cut into two segments each 1 inch long the magnitude will be only 7.5 volts. The output of the amplifier 56 is fed to a precise peak detector circuit 58 which detects the peak magnitude of the harmonic signal and has a quasi-dc output reflecting that peak. The output of the peak detector 58 is fed to comparator 60, designated "Comparator 1". The other input to the comparator 60 is a low threshold signal 62 derived from a six-channel rotary switch 64 (or in a simplified model, a potentiometer), the magnitude of the signal 62 being such as to be less than the output of the peak detector 58 if the magnetic strip 8 has a maximum continuous length significantly less than 2 inches. If the output of the peak detector 58 is higher than the low threshold signal 62, as will be the case if the 2-inch strip 8 has not been severed, comparator 60 will have one output, and if it is not higher the comparator 60 will have a different output. That output is fed to a 2.0 second alarm one-shot circuit 66 which will in turn energize an alarm LED 68 and/or an alarm beeper 70 on the detection of one such output or the other. Preferably,. for a reason explained below, the LED 68 and beeper 70 are energized when a "proper" strip 8 is detected.

Another output 72 from the six-channel rotary switch 64 (or a separate potentiometer in the simpler model) defines a reference voltage 73 which is higher than the output of the peak detector 58 when an uncut strip 8 is in position and energized, and that reference is compared, in comparator 74, designated "Comparator 2", with the output of the peak detector 58. Thus if an uncut 2-inch strip is present or if there is no strip present at all or if the 2-inch strip is cut there will be no output from comparator 74, but if, for example, a perpetrator removed strip 8 in the course of pilfering and then replaced it with a longer strip or with a strip of appropriately different magnetic characteristics such that the peak amplitude of the lower harmonic signal significantly exceeded that of the uncut 2-inch strip, comparator 74 would have an effective output which, passing through OR gate 76, would energize a 0.10 second inhibit one-shot circuit 78 which, via line 80, would inhibit and reset the alarm one-shot circuit 66, an effect which would occur so rapidly (since 0.10 second is significantly less than 2.0 second) that there would not be an alarm producing output from the one-shot circuit 66. This effect not only serves to make more difficult evasion of the pilferage detection circuitry of the present invention but also provides means by which the apparatus involved can be used to distinguish between two or more objects or types of objects which may have been initially provided with magnetic strips 8 of different lengths or other magnetic characteristics so as to provide means for distinguishing between the products involved. Whenever the one-shot inhibiting circuit 78 is actuated it will also actuate an inhibit LED 82 to indicate that it has functioned.

In order to reduce the susceptibility of the system to false alarms based upon detection of noise or other extraneous signals, comparator 84, designated "Comparator 3", is provided. An output from the notch filter 54 goes to bandpass amplifier 86 which passes higher harmonics such as harmonics 25–30, normally associated with noise. The output of amplifier 86 is fed to precise peak indicator 88 which measures the peak magnitude of the noise signal and feeds that to comparator 84 where it is compared with an adjustable threshold signal emanating from circuitry 90, and which is set to a value such as to be somewhat below the output of amplifier 86 when excessive noise is present. If excessive noise is present the comparator 84 will have an effective output which, passing through OR gate 76, prevents actuation of the alarm LED 68 or the alarm beeper 70, thus preventing a false pilferage alarm and at the same time indicating to the operator that the reason there is no alarm is because the circumstances are such that testing at that moment is inappropriate, and in effect instructing the operator to wait a few moments and then recheck.

FIGS. 7A–B through 12A–B illustrate typical wave forms for the output of the transmitter antenna 32 (FIG. 7), the output of the bandpass amplifier 56 (FIG. 8), the output of the peak detector 58 and its relation to the threshold value in comparators 60 and 74 (FIG. 9), the bandpass amplifier 86 (FIG. 10) and the output of the peak detector 88 in comparison with the adjustable threshold 90 (FIG. 11) as well as an indication of the alarm trigger signal.

One may provide an alarm trigger signal actuating the alarm LED 68 and the alarm beeper 70 whenever pilferage is detected, that is to say, whenever the output of the peak detector 58 is between the low threshold of comparator 60 and the high threshold of comparator 74. However, it is preferred that the LED 68 and beeper 70 be actuated when pilferage is not detected, and to be not actuated when pilferage is detected, thus producing a "fail safe" provision, since under those circumstances the LED 68 and beeper 70 will give their signals each time that a scan is made except when pilferage is detected or when the detector circuitry is not operative, thus advising the operator on each scan whether his equipment is indeed operating properly during that scan.

Use of the system of the present invention will therefore provide more reliable pilferage detection than has previously been possible, and with equipment which is practical in manufacture and manipulation. It provides for detection by means of a device—a thin magnetic strip hidden from view, and even if not hidden, not visually prominent—which not only is non-repairable when once cut but which cannot readily be replaced, particularly when utilized in conjunction with tamper-evident tape as disclosed. Moreover, the system of the present invention additionally provides for validation and identification under certain circumstances without adversely affecting its pilferage-detecting function.

The magnetic strip 8 may be a single strip of appropriate dimensions and character, but that is not necessary. A plurality of separate lengths of magnetic material can be used, possibly in predetermined relative spacing, to define the "proper" strip, thus facilitating the validation and identification capabilities of the system.

The same principles can be applied to the identification or authenticating of articles. For example, packages emanating from different companies can be provided with labels incorporating magnetic strips whose field-generating properties are unique to each company respectively. The uniqueness would be a function of the magnetic characteristics of the strip, the mechanical characteristics of the strip such as length, width, thickness, shape factor, number of strands, etc., the choice of the fundamental frequency of the transmitted field, the choice of receiver response bands and the choice of reference thresholds. For example, the signal for Company I can be set so that it only accepts uncut magnetic strips between 1.4 inch–1.6 inch in length, while the signal for Company II might be set to accept uncut labels between 1.7–1.9 inch in length, or Company I labels might contain two parallel magnetic strands while Company II labels might carry three such strands. Other possible variations will be apparent. Hence at a given transit station packages coming from or going to different concerns can be automatically identified and diverted along the appropriate transmission channel, and substitution of spurious packages for genuine packages can be instantly and automatically identified. Counterfeiting would be extremely difficult, since it would involve the proper choice of magnetic material, the proper choice of dimensions, the proper heat treatment or annealing of the magnetic material in order to produce a response which the system would not identify as counterfeit.

While but a single embodiment of the present invention has been here specifically disclosed, it will be apparent that many variations may be made therein, all within the scope of the present invention as defined in the following claims.

We claim:

1. The method of checking the security of an openable object which comprises (a) placing on said object across the openable area thereof a magnetic strip, and (b) subjecting said strip to a field affecting its magnetic status, detecting the field emanating from said strip, and giving an indication in response to said detected field of the presence or absence of a strip in proper condition.

2. The method of claim 1, in which the presence or absence of a strip in proper condition is determined by comparing a signal dependent on the nature of the field actually emanating from said strip and a reference signal representing a field smaller than that which would emanate from such a proper strip and causing said indication if said signal representing said actual field is greater than said reference signal.

3. The method of either of claims 1 or 2, in which the presence or absence of a strip in proper condition is detected on the basis of the characteristic of said strip that it loses a substantial portion of its magnetic field activity if it is cut.

4. The method of claim 2, in which the condition of a strip is determined by the shape factor of said strip, which is different if said strip is cut or not.

5. The method of claim 4, in which the presence or absence of a proper strip is determined by detecting the lower harmonics of the field emanating from said strip.

6. The method of claim 5, in which said lower harmonics comprises harmonics 5–15.

7. The method of claim 1, in which the proper condition of a strip is determined by the shape factor of said strip which is different if said strip is cut or is not.

8. The method of claim 7, in which the presence or absence of a proper strip is determined by detecting the lower harmonics of the field emanating from said strip.

9. The method of claim 8, in which said lower harmonics comprises harmonics 5–15.

10. In the method of any of claims 1, 2, 8 or 9, testing for the presence of undesirable conditions at the time of said strip field detection, and preventing said indication in the event that said undesirable conditions are detected.

11. In the method of claim 10, preventing said indication by comparing the intensity of higher harmonics of said emanating field with a predetermined standard.

12. The method of claim 11, in which said higher harmonics comprises harmonics 25–30.

13. In the method of any of claims 1, 2, 8 or 9, comparing said actual field signal with a reference signal corresponding to that which would emanate from a proper strip of predetermined dimensions, and preventing said indication of a proper strip in the event that said reference signal is less than said actual field signal.

14. The method of claim 13, in which said actual field signal is based upon lower harmonics of said signal comprising harmonics 5–15.

15. A device for use with an openable object for detecting whether said object has been opened which comprises a body securable to said object so as to extend across the openable portion thereof, said body comprising a magnetic strip which spans said openable portion and which has a shape factor such that when subjected to an external field the field emanating therefrom will be significantly different if said strip has been cut than if it has not been cut.

16. The device of claim 15, in which said strip has a shape factor figure of merit of at least about 200.

17. The device of claim 15 in which said body further comprises a strip secured to said object and of a type such as to leave visible evidence on the object if an attempt is made to wholly or partially remove said strip from said object.

18. The device of claim 17, in which said latter strip when in place on said object hides said former strip from view.

19. The device of claim 17, in which said body further comprises a tamper-evident strip.

20. A device for use with an openable object for detecting whether said object has been opened which comprises a body securable to said object so as to extend across the openable portion thereof, said body comprising a magnetic strip which spans said openable portion and which has the characteristic that when it is cut its magnetic properties are substantially altered.

21. The device of claim 20, in which said body further comprises a strip secured to said object and of a type such as to leave visible evidence on the object if an attempt is made to wholly or partially remove said strip from said object.

22. The device of claim 21, in which said latter strip when in place on said object hides said former strip from view.

23. The device of claim 21, in which said body further comprises a tamper-evident strip.

24. The method of identifying a package which comprises (a) placing on said package a magnetic strip which when exposed to a given external field produces an electromagnetic field of predetermined nature, and (b) subjecting said strip on said package to said given external field, detecting said field produced by said strip, and giving an indication in accordance with said detected field as to whether said detected field is of said predetermined nature or not.

25. The method of claim 24, in which the presence of absence of a strip identifying said object is determined by comparing a signal dependent on the nature of said detected field and a reference signal representing said field of predetermined nature and causing said indication on the basis of a comparison between said signals.

26. The method of either of claims 24 or 25, in which said predetermined nature of said produced field is determined by a combination of the magnetic and mechanical characteristics of said strip and the nature of said given external field.

* * * * *